US009562355B2

(12) United States Patent
Iihoshi et al.

(10) Patent No.: US 9,562,355 B2
(45) Date of Patent: Feb. 7, 2017

(54) REBAR STRUCTURE AND REINFORCED CONCRETE MEMBER

(71) Applicant: NETUREN CO., LTD., Tokyo (JP)

(72) Inventors: Fukuma Iihoshi, Tokyo (JP); Yoshiyuki Murata, Tokyo (JP); Yoshifumi Nakamura, Tokyo (JP)

(73) Assignee: NETUREN CO., LTD., Tokyo (JP)

( * ) Notice: Subject to any disclaimer, the term of this patent is extended or adjusted under 35 U.S.C. 154(b) by 0 days.

(21) Appl. No.: 14/965,352

(22) Filed: Dec. 10, 2015

(65) Prior Publication Data

US 2016/0097201 A1 Apr. 7, 2016

Related U.S. Application Data

(63) Continuation of application No. 13/896,812, filed on May 17, 2013, now Pat. No. 9,260,866.

(30) Foreign Application Priority Data

May 18, 2012 (JP) ..... 2012-114481
Jun. 8, 2012 (JP) ..... 2012-130668
Jun. 8, 2012 (JP) ..... 2012-130669

(51) Int. Cl.

*E04C 5/06* (2006.01)
*E04C 5/00* (2006.01)
*E04C 3/34* (2006.01)
*E04B 5/43* (2006.01)

(52) U.S. Cl.

CPC ..... *E04C 5/0622* (2013.01); *E04C 3/34* (2013.01); *E04C 5/00* (2013.01); *E04C 5/0645* (2013.01); *E04B 5/43* (2013.01)

(58) Field of Classification Search

CPC .... E04C 5/0645; E04C 5/0618; E04C 5/0604; E04C 5/16; E04C 5/0622; E04C 5/162; E04C 3/34; E04C 5/00; E04B 5/43
USPC ..... 52/664, 250, 251, 252, 253
See application file for complete search history.

(56) References Cited

U.S. PATENT DOCUMENTS 1,078,575 A * 11/1913 Cowles ..... E04B 5/43 52/253
1,461,891 A 7/1923 Coney
2,768,520 A 10/1956 Strehan
(Continued)

FOREIGN PATENT DOCUMENTS

JP 2-88832 3/1990
JP 03-206221 9/1991
(Continued)

OTHER PUBLICATIONS

JP10-30273 Translation, obtained from Japan Platform for Patent Information, https://www4.j-platpat.inpit.go.jp/eng/tokujitsu/tkbs_en_TKBS_EN_GM301_Detailed.action.*
(Continued)

*Primary Examiner* — James Ference
(74) *Attorney, Agent, or Firm* — Wenderoth, Lind & Ponack, L.L.P.

(57) ABSTRACT

A rebar structure includes a plurality of column longitudinal bars to be connected to a beam. The yield point or the 0.2% proof stress of at least a portion the column longitudinal bars is larger than the yield point or the 0.2% proof stress of a normal reinforcing bar defined by JIS G 3112.

4 Claims, 14 Drawing Sheets

(56) References Cited

U.S. PATENT DOCUMENTS

| | | | | |
|---|---|---|---|---|
| 3,245,189 | A * | 4/1966 | Reiland | E04C 5/165 403/313 |
| 3,473,285 | A * | 10/1969 | Reiland | E04C 5/163 52/295 |
| 3,475,876 | A | 11/1969 | Oroschakoff | |
| 3,744,207 | A | 7/1973 | Oroschakoff | |
| 3,820,293 | A | 6/1974 | Ohe et al. | |
| 3,903,667 | A * | 9/1975 | Zetlin | E04B 5/48 52/220.3 |
| 3,916,592 | A | 11/1975 | Morohashi et al. | |
| 4,119,764 | A | 10/1978 | Mizuma et al. | |
| 4,187,118 | A | 2/1980 | Nakagawa et al. | |
| 4,196,557 | A | 4/1980 | Silvander | |
| 4,211,045 | A | 7/1980 | Koizumi et al. | |
| 4,230,499 | A | 10/1980 | Nakagawa et al. | |
| 4,323,404 | A | 4/1982 | Sawada et al. | |
| 4,333,285 | A | 6/1982 | Koizumi et al. | |
| 4,393,639 | A | 7/1983 | Bucher | |
| 4,450,703 | A | 5/1984 | McCloskey | |
| 4,472,331 | A | 9/1984 | Kida | |
| 4,627,998 | A | 12/1986 | Akihama et al. | |
| 4,769,886 | A | 9/1988 | Berchem et al. | |
| 4,784,922 | A | 11/1988 | Yoshimura | |
| 4,922,681 | A | 5/1990 | Russwurm et al. | |
| 5,181,359 | A | 1/1993 | Chana et al. | |
| 5,216,860 | A | 6/1993 | Thomson et al. | |
| 5,236,520 | A | 8/1993 | Gallagher, Jr. | |
| 5,308,184 | A | 5/1994 | Bernard | |
| 5,392,580 | A * | 2/1995 | Baumann | B21F 27/125 52/646 |
| 5,491,941 | A | 2/1996 | Lancelot, III | |
| 5,682,717 | A * | 11/1997 | Carranza-Aubry | E04B 5/43 52/251 |
| 5,875,669 | A | 3/1999 | Takeda et al. | |
| 6,058,672 | A | 5/2000 | McClellan | |
| 6,059,903 | A | 5/2000 | Roloff et al. | |
| 6,065,263 | A | 5/2000 | Taguchi | |
| 6,074,765 | A | 6/2000 | Pugh | |
| 6,192,647 | B1 | 2/2001 | Dahl | |
| 6,293,071 | B1 | 9/2001 | Konstantinidis | |
| 6,327,829 | B1 | 12/2001 | Taguchi | |
| 6,328,829 | B1 | 12/2001 | Kato et al. | |
| 6,385,930 | B1 | 5/2002 | Broms et al. | |
| 6,625,943 | B1 | 9/2003 | Renner | |
| 6,631,592 | B1 | 10/2003 | Hancock | |
| 6,662,506 | B2 | 12/2003 | Fischer et al. | |
| 6,685,399 | B2 | 2/2004 | Iemura et al. | |
| 6,874,233 | B2 | 4/2005 | Harding | |
| 7,143,554 | B2 | 12/2006 | Sachs et al. | |
| 7,421,827 | B1 | 9/2008 | Konstantinidis | |
| 7,585,562 | B2 | 9/2009 | Hasui et al. | |
| 7,637,136 | B2 | 12/2009 | Horita et al. | |
| 2001/0046417 | A1 | 11/2001 | Iemura et al. | |
| 2002/0002801 | A1 | 1/2002 | Fischer et al. | |
| 2004/0007801 | A1 | 1/2004 | Fukumura | |
| 2005/0235597 | A1 | 10/2005 | Li et al. | |
| 2006/0059841 | A1 | 3/2006 | Bennett et al. | |
| 2007/0095013 | A1 | 5/2007 | Kerkay | |
| 2008/0083181 | A1 | 4/2008 | Ospina | |
| 2008/0263978 | A1 | 10/2008 | Abou-Saleh | |
| 2009/0139177 | A1 | 6/2009 | Holdsworth et al. | |
| 2009/0151298 | A1 | 6/2009 | Jazzar | |
| 2009/0178356 | A1 | 7/2009 | Baumann | |
| 2010/0024344 | A1 | 2/2010 | Murayama et al. | |
| 2010/0088995 | A1 | 4/2010 | Murayama et al. | |
| 2010/0107520 | A1 | 5/2010 | Lundmark et al. | |
| 2011/0088348 | A1 | 4/2011 | Rahimzadeh et al. | |
| 2011/0173919 | A1 | 7/2011 | Bonelli | |
| 2011/0192108 | A1* | 8/2011 | Kim | E04C 5/0645 52/650.3 |
| 2012/0047816 | A1 | 3/2012 | Zhong | |
| 2012/0210669 | A1* | 8/2012 | Lee | E04C 3/44 52/649.2 |
| 2012/0233936 | A1 | 9/2012 | Zhong | |
| 2013/0305652 | A1 | 11/2013 | Iihoshi et al. | |

FOREIGN PATENT DOCUMENTS

| | | |
|---|---|---|
| JP | 04-16635 | 1/1992 |
| JP | H1030273 | 2/1998 |
| JP | 4151245 | 7/2008 |
| JP | 3147699 | 12/2008 |
| JP | 2010-236217 | 10/2010 |

OTHER PUBLICATIONS

English Translation of Abstract from JPH1030273 (A) dated Feb. 1998.

First Examination Report dated Feb. 25, 2014 issued by the New Zealand Intellectual Property Office in counterpart New Zealand Application No. 621470.

First Examination Report dated May 23, 2013 issued by the New Zealand Intellectual Property Office in counterpart New Zealand Application No. 610739.

Caifu, Yang, "Development of High Strength Construction Rebars", Proceedings of International Seminar on Production and Application of High Strength Seismic Grade Rebar Containing Vanadium, Beijing, China, Jun. 2010, pp. 58-70.

Miyajima, Masakatsu, "The Japanese Experience in Design and Application of Seismic Grade Rebar", Proceedings of International Seminar on Production and Application of High Strength Seismic Grade Rebar Containing Vanadium, Beijing, China, Jun. 2010, pp. 12-16.

* cited by examiner

REBAR STRUCTURE AND REINFORCED CONCRETE MEMBER

CROSS-REFERENCE TO RELATED APPLICATIONS

The present application claims priority from Japanese Patent Application No. 2012-114481 filed on May 18, 2012, Japanese Patent Application No. 2012-130668 filed on Jun. 8, 2012, and Japanese Patent Application No. 2012-130669 filed on Jun. 8, 2012, the entire contents of which are incorporated herein by reference.

FIELD OF INVENTION

The present invention relates to a rebar structure and a reinforced concrete member.

BACKGROUND

A first related art rebar structure includes columns and beams to be connected to the columns.

In a beam-column connecting portion of such a rebar structure where a column and beam are connected together (a panel zone), longitudinal bars (main reinforcement) and shear reinforcing bars for the column and longitudinal bars (main reinforcement) for the beam are arranged, and concrete is placed thereon. According to Standard for Structural Calculation of Reinforced Concrete Structures, the first impression of the eighth edition (Edited by Architectural Institute of Japan), generally, the beam-column connecting portion is designed in accordance with allowable shearing force Q which can be obtained from the following equation.

$Q=\kappa(f-0.5)\,bD$ ($\kappa$: a coefficient according to the shape of the beam-column connecting portion, f: short-term allowable shearing unit stress of concrete, b: effective width of beam-column connecting portion, D: column depth)

For example, in a rebar structure disclosed in JP 3147699 U, column longitudinal bars include a normal strength portion having a given strength and a joint section and a high strength portion having a higher strength than the given strength. The normal strength portion is arranged in the central portion of the column longitudinal bars, and the high strength portion is arranged in the portion to be connected to a beam. In such column longitudinal bars, the ends of the normal strength portion are connected together by joining means such as welding.

However, in the generally-designed rebar structure, in order to increase the allowable shearing stress (shearing proof stress) of the beam-column connecting portion thereof, it is required to either increase the strength of the concrete by changing its base material or, as can be understood from the above equation, increase the section area of the beam-column connecting portion by increasing the column depth D.

When the concrete strength is increased, the cost of the structure is increased. Also, when the section area of the beam-column connecting portion is increased, the section areas of the entire column and the entire beam are increased, which narrows a living space.

According to JP 3147699 U, the longitudinal bars are partially reinforced to solve the problem of reliably connecting the reinforcing bars having different strengths, but JP 3147699 U does not address the narrowing of the living space.

A second related art rebar structure uses reinforcing bars in columns and beams, and in its beam-column connecting portion where a column and a beam are cross-connected together, column longitudinal bars arranged in the column and beam longitudinal bars arranged in the beam are connected together, and shear reinforcing bars are further arranged at this portion.

At this beam-column connecting portion, in addition to the axial force of the column acting thereon, and also forces generated due to repeated application of loads to the column and the beam act on the portions of the column corresponding to the upper and lower portions of the beam-column connecting portion, which may cause cracks in the concrete placed on the rebar structure thereby reducing the strength of the column. Especially, at the time of an earthquake, the displacements of the beams are larger than those of the columns and, when great force in the vertical direction (direction perpendicular to the columns) is applied to the columns due to the beam displacements, the portions of the columns corresponding to the upper and lower sides of the beams (that is, the portions of the columns corresponding to the upper and lower sides of the beam-column connecting portion) are caused to crack. In order to prevent such crack or the like, it is necessary to reinforce the beam-column connecting portion.

For example, in a rebar structure disclosed in JP 2010-236217 A, in order to prevent cracks in the upper and lower ends of the beam-column connecting portion from developing, reinforcing bands are provided to surround the column longitudinal bars.

However, in the rebar structure of JP 2010-236217 A, the reinforcing bands are provided on the upper and lower ends of the beam-column connecting portion, so that the reinforcing bands adjoin the beam longitudinal bars, and the working efficiency for providing the reinforcing bands is not taken into consideration.

Also, since the reinforcing bands are provided on the upper and lower ends of the beam-column connecting portion, the reinforcement of the columns with respect to the shearing stress applied to the columns is not always sufficient. Also, there is a demand for a reinforcement of larger columns.

A third related art rebar structure includes a plurality of longitudinal bars extending in an axial direction and a plurality of shear reinforcing bars surrounding the longitudinal bars for reinforcing the shear strength thereof. When there is a difference between the amount of the longitudinal bars in the end portion of the member and the amount of the longitudinal bars in the central portion of the member, the longitudinal bars may be arranged along the entire length of the member, in order to prevent the longitudinal bars from slipping and moving out of the inside of the reinforced concrete member even when the longitudinal bars receive bending tension. However, this increases the amount of the longitudinal bars, requires additional parts for connecting the longitudinal bars to each other, and increases the workload for connecting the longitudinal bars. Also, the amount of the shear reinforcing bars may be increased to improve the bond strength between the longitudinal bars and the concrete so as to suppress the slipping of the longitudinal bars. However, this increases the amount of the shear reinforcing bars and thus increases the workload for arranging the shear reinforcing bars.

In view of this, bond reinforcing bars may be used in addition to the shear reinforcing bars. For example, in a rebar structure disclosed in JP 4151245 B2, a longitudinal bar is surrounded by a bond reinforcing bar, or, a plurality of longitudinal bars arranged inwardly of longitudinal bars arranged at the outermost periphery of the structure are surrounded by a bond reinforcing bar.

However, in the rebar structure as disclosed in JP 4151245 B2, although a longitudinal bar is surrounded by a bond reinforcing bar, or, a plurality of longitudinal bars is surrounded by a bond reinforcing bar, a longitudinal bar arranged in the outermost periphery of the structure is not surrounded by the bond reinforcing bar. Therefore, there is a limit to providing sufficient reinforcement of the outermost peripheral side of the rebar structure that receives the shearing force the most.

SUMMARY

It is an object of the invention to provide a rebar structure which can increase the proof stress of column longitudinal bars and thus can reduce the section areas of the columns.

It is another object of the invention to provide a rebar structure which can provide good working efficiency when providing a reinforcing member and can reinforce columns sufficiently with respect to shearing stress.

It is another object of the invention to provide a rebar structure and a reinforced concrete member, which can reinforce its outermost peripheral side that receives the shearing force the most.

According to an aspect of the present invention, a rebar structure includes a plurality of column longitudinal bars to be connected to a beam, and the yield point or the 0.2% proof stress of at least a portion the column longitudinal bars is larger than the yield point or the 0.2% proof stress of the normal reinforcing bar defined by JIS G 3112.

With this configuration, because the yield point or the 0.2% proof stress of at least a portion of the column longitudinal bars is larger than the yield point or the 0.2% proof stress of the normal reinforcing bar defined as a steel bar for reinforced concrete in JIS G 3112, at least a portion of the column longitudinal bars has high strength. Therefore, each of the column longitudinal bars can be thinned and thus a space between the mutually adjoining longitudinal bars can be reduced, thereby being able to reduce a section area of a column.

According to another aspect of the present invention, the column includes a plurality of column shear reinforcing bars arranged to surround the column longitudinal bars in a plane intersecting an axial direction of the column longitudinal bars, and the yield point or the 0.2% proof stress of the plurality of column shear reinforcing bars is larger than the yield point or the 0.2% proof stress of the normal reinforcing bar.

With this configuration, because the yield point or the 0.2% proof stress of the column shear reinforcing bar is larger than the yield point or the 0.2% proof stress of the normal reinforcing bar, the shearing force that can be borne by the shear reinforcing bars is increased, whereby the part borne by the concrete section of the column can be reduced accordingly. This can reduce the section area of the column further.

According to another aspect of the present invention, the portion having the yield point or the 0.2% proof stress that is larger than the yield point or the 0.2% proof stress of the normal reinforcing bar includes a beam-column connecting portion of the column longitudinal bars where the beam is connected.

With this configuration, the portion having the yield point or the 0.2% proof stress that is larger than the yield point or the 0.2% proof stress of the normal reinforcing bar includes the beam-column connecting portion where the beam is connected. Although stress applied to the column concentrates on the beam-column connecting portion, since at least the beam-column connecting portion of the column longitudinal bars is made high in strength, the proof stress of the column in the beam-column connecting portion can be improved.

According to another aspect of the present invention, the column longitudinal bars include a high-strength reinforcing bar portion having the yield point or the 0.2% proof stress larger than the yield point or the 0.2% proof stress of the normal reinforcing bar and a normal reinforcing bar portion formed by the normal reinforcing bar.

With this configuration, because the column longitudinal bars include the high-strength reinforcing bar portion and the normal reinforcing bar portion, when compared with a structure where the entire portion of the longitudinal bars is made high in strength, the cost can be reduced.

According to another aspect of the present invention, an end portion of each of the column longitudinal bars is arranged to overlap an end portion of another column longitudinal bar in a direction intersecting the axial direction of the column longitudinal bars.

With this configuration, because the end portion of the column longitudinal bar can be overlapped with the end portion of the other column longitudinal bar, when connecting the column longitudinal bar to the other column longitudinal bar, the connection can be facilitated.

According to another aspect of the present invention, the column longitudinal bars are formed by quenching the normal reinforcing bars.

With this configuration, because the column longitudinal bars are formed by quenching the normal reinforcing bars, its strength can be made reliably higher than the normal reinforcing bar used as the base material.

According to another aspect of the present invention, a rebar includes a column and a beam that are connected together, the column including a plurality of column longitudinal bars arranged to extend in a vertical direction and a plurality of column shear reinforcing bars arranged to surround the column longitudinal bars in a plane intersecting an axial direction of the column longitudinal bars, and the beam including a plurality of beam longitudinal bars arranged to extend in a horizontal direction. In a beam-column connecting portion where the column and the beam are connected together, a reinforcing member having a closed form is provided to surround and to restrain the column longitudinal bars. A width of the reinforcing member in the axial direction of the column longitudinal bars is larger than a width of the column shear reinforcing bars in the axial direction of the column longitudinal bars, and the reinforcing member is spaced from an upper end and an lower end of the beam-column connecting portion respectively in the axial direction of the column longitudinal bars.

With this configuration, because the reinforcing member is spaced from the upper end and the lower end of the beam-column connecting portion respectively in the axial direction of the column longitudinal bars, the reinforcing member is separated from the beam longitudinal bars, so that it is easy to provide the reinforcing member. Also, the shearing stress applied to the columns acts on the center of the beam-column connecting portion most greatly. Thus, the portion on which the shearing stress acts the most can be reinforced by the reinforcing member, which makes it possible to reinforce the column with respect to the shearing stress sufficiently.

According to another aspect of the present invention, the reinforcing member includes an outer frame and a partition portion connecting inner surfaces of the outer frame to partition an inside of the outer frame.

With this configuration, since the reinforcing member includes a partition portion connecting the inner surfaces of the outer frame to partition the inside of the outer frame, the outer frame is reinforced by the partition portion. Therefore, since the outer frame reinforced by the partition portion cooperates with the partition portion in surrounding the column longitudinal bars, the reinforcement of the column with respect to the shearing stress can be enhanced.

According to another aspect of the present invention, the reinforcing member has a closed frame shape in which ends of a band-shaped member are butted against each other and are connected together by welding.

With this configuration, since the reinforcing member has a closed frame shape in which the ends of a band-shaped member are butted against each other and are connected together by welding, the reinforcing member is strong as a whole, thereby being able to enhance the reinforcement of the column with respect to the shearing stress. Also, since the whole reinforcing member can be made greatly strong by welding, its strength can be enhanced easily.

According to another aspect of the present invention, a rebar structure includes a plurality of longitudinal bars extending in an axial direction, a plurality of shear reinforcing bars arranged to surround the longitudinal bars in a rectangular form in a plane intersecting the axial direction of the longitudinal bars, and a plurality of bond reinforcing bars arranged adjacent to the shear reinforcing bars in the axial direction of the longitudinal bars. The longitudinal bars include a first longitudinal bar, a second longitudinal bar, a third longitudinal bar and a fourth longitudinal bar that are arranged clockwise at least at four corners of the shear reinforcing bars, a fifth longitudinal bar provided between the first longitudinal bar and the second longitudinal bar and adjacent to the first longitudinal bar, a sixth longitudinal bar provided between the first longitudinal bar and the second longitudinal bar and adjacent to the second longitudinal bar, a seventh longitudinal bar provided between the third longitudinal bar and the fourth longitudinal bar and adjacent to the third longitudinal bar, and an eighth longitudinal bar provided between the third longitudinal bar and the fourth longitudinal bar and adjacent to the fourth longitudinal bar. The bond reinforcing bars include a first bond reinforcing bar provided around at least the first longitudinal bar and the fourth longitudinal bar and having an inner periphery facing the fifth longitudinal bar and the eighth longitudinal bar.

With this configuration, the bond reinforcing bars include the first bond reinforcing bar provided around at least the first longitudinal bar and the fourth longitudinal bar and having the inner periphery facing the fifth longitudinal bar and the eighth longitudinal bar. Therefore, the outer peripheral end side of the rebar structure that receives the shearing force the most can be reinforced in a localized manner.

According to another aspect of the present invention, the bond reinforcing bars include a U-shaped portion having a back section extending in a direction perpendicular to the axial direction of the longitudinal bars and a pair of bent sections bent from respective ends of the back section, and a pair of leg portions extending from leading ends of the bent sections in axial directions of the bent sections. The U-shaped portion faces at least the first and the fourth longitudinal bars, and leading ends of the leg portions do not reach a middle position between the first longitudinal bar and the second longitudinal bar and a middle position between the third longitudinal bar and the fourth longitudinal bar.

With this configuration, the bond reinforcing bar includes the pair of leg portions extending from the leading ends of the bent sections in the axial directions of the bent sections, and the leading ends of the leg portions do not reach the middle position between the first longitudinal bar and the second longitudinal bar and the middle position between the third longitudinal bar and the fourth longitudinal bar. Therefore, when building the rebar structure, the arrangement of the bond reinforcing bar can be facilitated.

According to another aspect of the present invention, the bond reinforcing bars include a U-shaped portion having a back section extending in a direction perpendicular to the axial direction of the longitudinal bars and a pair of bent sections bent from respective ends of the back section, and a pair of leg portions having base ends connected to the bent sections and leading ends oriented in mutually approaching directions. The U-shaped portion faces at least the first longitudinal bar and the fourth longitudinal bar, and the leading ends of the leg portions do not reach the middle position between the first longitudinal bar and the second longitudinal bar and the middle position between the third longitudinal bar and the fourth longitudinal bar.

With this configuration, the bond reinforcing bars include the paired leg portions having the base ends connected to the bent sections and the leading ends oriented in the mutually approaching directions. The leading ends of the leg portions do not reach the middle position between the first longitudinal bar and the second longitudinal bar and the middle position between the third longitudinal bar and the fourth longitudinal bar. This makes it hard for the bond reinforcing bar to be removed from inside the rebar structure. Also, when building the rebar structure, the arrangement of the bond reinforcing bar can be facilitated.

According to another aspect of the present invention, the bond reinforcing bars include a second bond reinforcing bar provided around at least the second longitudinal bar and the third longitudinal bar and having an inner periphery facing the sixth longitudinal bar and the seventh longitudinal bar.

With this configuration, the bond reinforcing bars include the second bond reinforcing bar provided around at least the second longitudinal bar and the third longitudinal bar and having the inner periphery facing the sixth longitudinal bar and the seventh longitudinal bar. Therefore, the outer peripheral end side of the rebar structure that receives the shearing force the most can be further reinforced in a localized manner.

According to another aspect of the present invention, a reinforced concrete member has the above-described rebar structure embedded therein.

With this configuration, since the rebar structure is embedded therein, the outer peripheral end side of the rebar structure that receives the shearing force the most can be reinforced in a localized manner.

DETAILED DESCRIPTION

Hereinafter, embodiments of the invention will be described with reference to the drawings.

Figure 1:
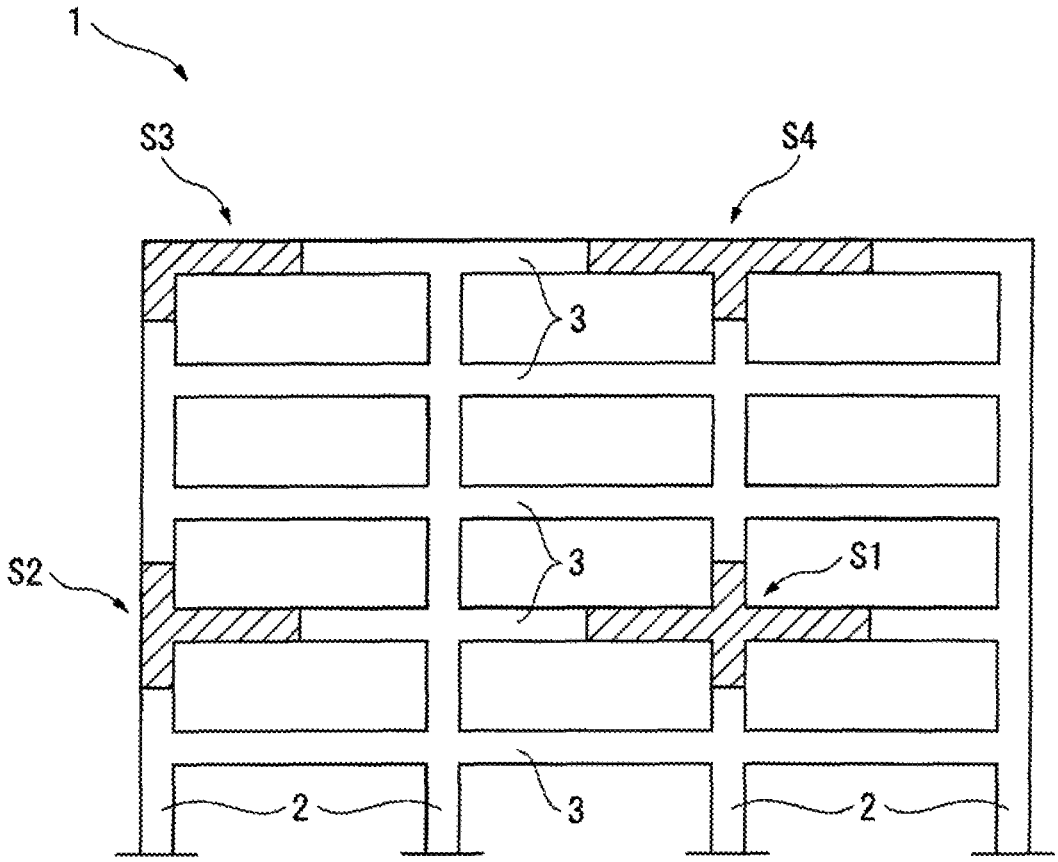
FIG. 1 is a diagram of a building having a rebar structure according to embodiments of the invention.
Figure 2:
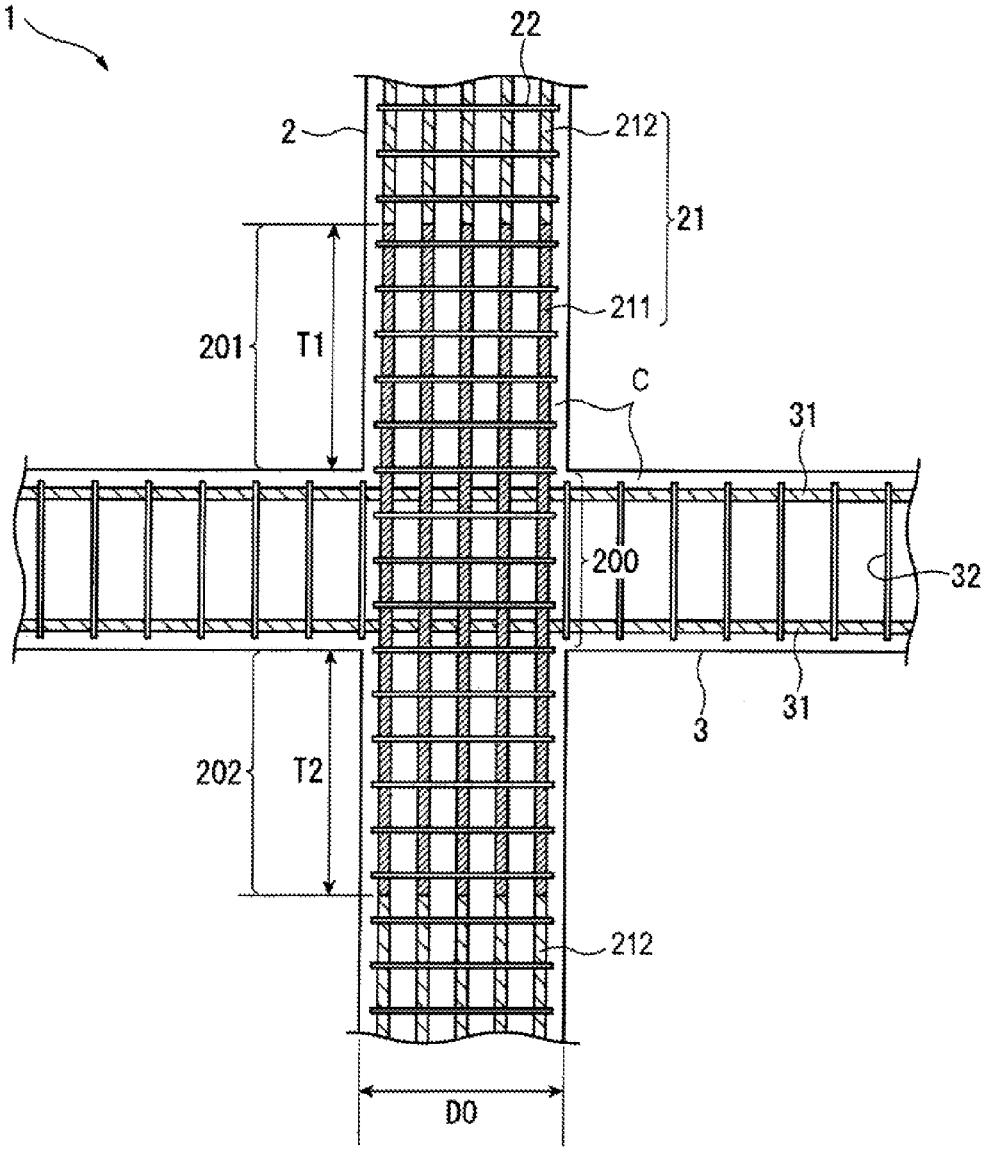
FIG. 2 is a section view of a portion of a rebar structure according to a first embodiment of the invention.

As shown in FIGS. 1 and 2, a rebar structure 1 according to embodiments of the invention may be applied to a multi-story building built of reinforced concrete. The building includes a plurality of columns 2 and a plurality of beams 3 to be connected to the columns 2, and concrete C is placed on the rebar structure 1.

Connections of the columns 2 and the beams 3 include a cross connection S1, a horizontal T-shape connection S2, an L-shape connection S3 and a vertical T-shape connection S4, and this embodiment is applicable to these connections S1 to S4. In the following, the cross connection S1 will be described as an example.

According to a first embodiment, as shown in FIG. 2, a column 2 has a column depth D0, and its rebar structure includes a plurality of column longitudinal bars 21 (main reinforcement of the column 2) extending vertically and arranged at regular intervals and a plurality of column shear reinforcing bars 22 arranged at regular intervals to surround the longitudinal bars 21 in a plane intersecting the axial direction of the longitudinal bars 21 (a plane perpendicular to the surface of the sheet of FIG. 2) for reinforcing the shear strength of the column 2.

The longitudinal bars 21 include a high-strength reinforcing bar portion 211 having the yield point or the 0.2% proof stress larger than the yield point or the 0.2% proof stress of a normal reinforcing bar defined by JIS G 3112 (hereinafter, simply described as the normal reinforcing bar), and a normal reinforcing bar portion 212 formed by a normal reinforcing bar. In this embodiment, the yield point or the 0.2% proof stress of the high-strength reinforcing bar portion 211 is 900 MPa ($N/mm^2$), while the yield point or the 0.2% proof stress of the normal reinforcing bar portion 212 is 390 MPa ($N/mm^2$). Also, the longitudinal bar 21 may also be a round steel bar or a deformed steel bar.

The high-strength reinforcing bar portion 211 ranges from an upper area 201 existing upwardly of the beam-column connecting portion 200 (the panel zone) to a lower area 202 existing downwardly of the beam-column connecting portion 200, including the beam-column connecting portion 200 used as the connecting portion of the columns 2 and beams 3. The distance T1 between the upper end of the upper area 201 and the upper end of the beam-column connecting portion 200 is approximately 1.1 times to 1.3 times the column depth D0 (T1≈D0×1.1 to D0×1.3). Similarly, the distance T2 between the lower end of the lower area 202 and the lower end of the beam-column connecting portion 200 is approx. 1.1 times to 1.3 times the column depth D0 (T2≈D0×1.1 to D0×1.3). These distances T1 and T2 can be obtained from a ratio of the yield point or the 0.2% proof stress of the high-strength reinforcing bar portion 211 to the yield point or the 0.2% proof stress of the normal reinforcing bar portion 212 when the inter-layer dimension between the mutually adjoining beams 3 is set four times the column depth D0.

Such a high-strength reinforcing bar portion 211 is formed by inserting a normal reinforcing bar as abase material of the longitudinal bar into a heating coil (not shown) and by partially quenching only a portion of the longitudinal bar 21 corresponding to the beam-column connecting portion 200, the upper area 201 and the lower area 202.

Figure 3:
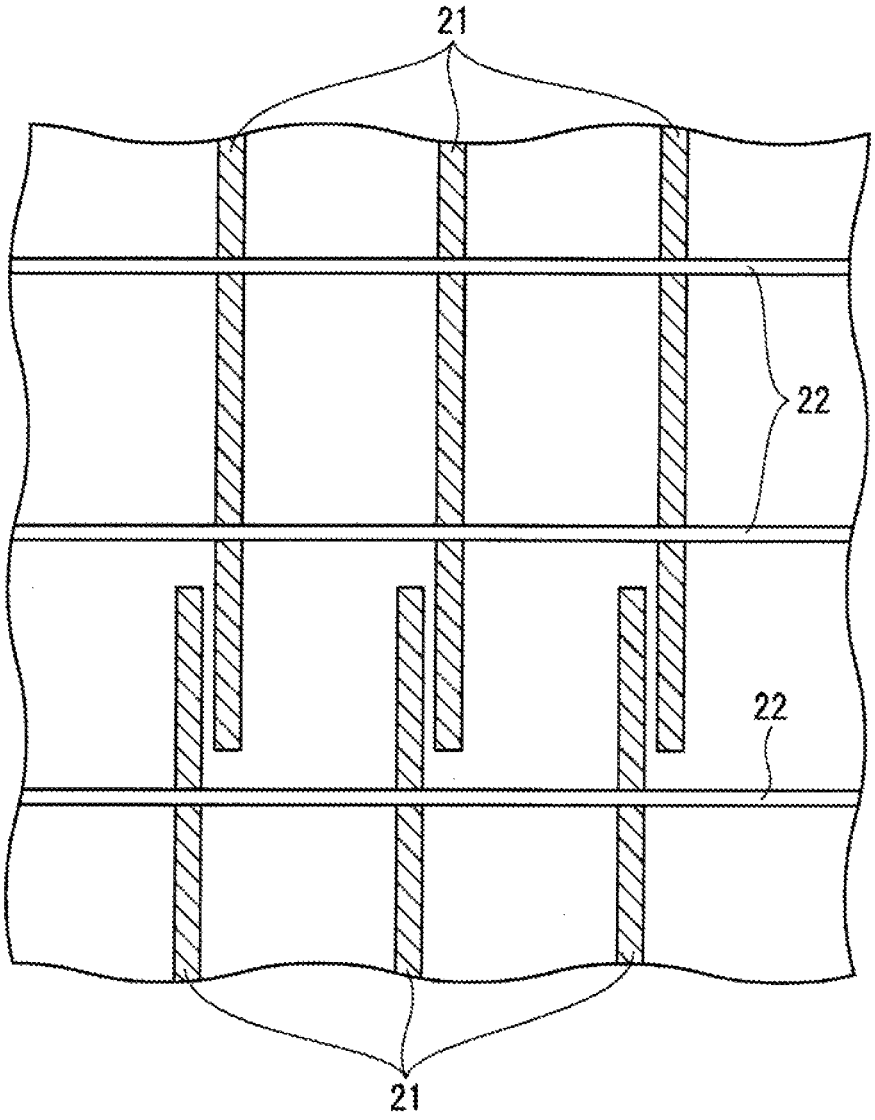
FIG. 3 is a section view of end portions of longitudinal bars according to embodiments of the invention.

As shown in FIG. 3, to connect the longitudinal bars 21 arranged in series in the axial direction, the upper and lower end portions of the longitudinal bars 21 partially overlap the end portions of the other longitudinal bars 21 in a direction intersecting the axial direction of the longitudinal bars 21 (in the horizontal direction in FIG. 2). The overlapped portions can be connected together as necessary.

The shear reinforcing bar 22 is "ULBON 1275" (a trade name, product of Neturen Co., Ltd) having a yield point or a 0.2% proof stress (900 MPa) larger than the yield point or the 0.2% proof stress (390 MPa) of a normal reinforcing bar.

The shear reinforcing bars 22 are arranged in the extending direction of the longitudinal bars 21, including the beam-column connecting portion 200.

A rebar structure forming the beam 3 includes a plurality of beam longitudinal bars 31 (main reinforcement of the beam 3) extending horizontally and arranged at given intervals, and a plurality of beam shear reinforcing bars 32 arranged at regular intervals in the extending direction of the longitudinal bars 31 to surround the longitudinal bars 31 in a plane intersecting the axial direction of the longitudinal bars 31 (a plane perpendicular to the surface of the sheet of FIG. 2) for reinforcing the shear strength of the beam 3. The longitudinal bars 31 and the shear reinforcing bars 32 are normal reinforcing bars.

Next, in order to clarify that the flexural capacity of the high-strength reinforcing bar portion 211 is larger than the flexural capacity of the normal reinforcing bar portion 212, description is given of a test conducted to check the flexural capacity of the column 2 with respect to the shearing force.

Figure 4:
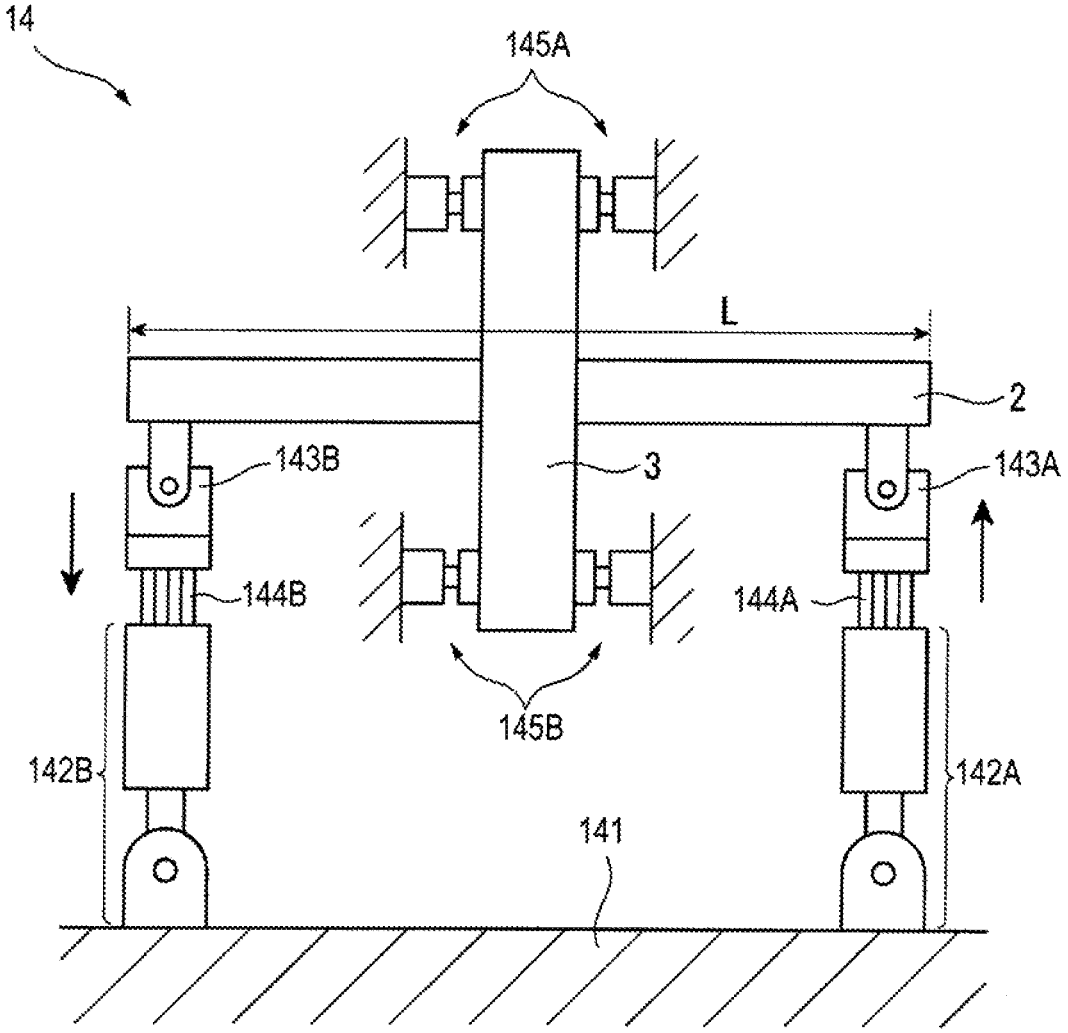
FIG. 4 is a diagram illustrating a test apparatus used to conduct a test on a column.

FIG. 4 illustrates a test apparatus 14.

The test apparatus 14 includes a test bed 141, a first fixed portion 142A provided on and fixed to the test bed 141 on one end side of the column 2 and a second fixed portion 142B provided on and fixed to the other end side of the column 2, a first load apply portion 143A for applying a load to the one end side of the column 2 and a second load apply portion 143B for applying a load to the other end side of the column 2, a first measuring portion 144A interposed between the first fixed portion 142A and first load apply portion 143A for supporting the first load apply portion 143A movably, a second measuring portion 144B interposed between the second fixing portion 142B and second load apply portion 143B for supporting the second load apply portion 143B movably, and hold portions 145A, 145B respectively for holding the upper and lower ends of the beam 3.

A sensor (not shown) or the like for measuring the amount of the movement of the first load apply portion 143A is mounted on the first measuring portion 144A. Here, the upward movement of the first load apply portion 143A in FIG. 4 is defined as the positive movement, while the downward movement in FIG. 4 is defined as the negative movement.

On the second measuring portion 144B as well, there is mounted a sensor (not shown) or the like for measuring the amount of movement of the second load apply portion 143B. Here, the downward movement of the second load apply portion 143B in FIG. 4 is defined as the positive movement, while the upward movement in FIG. 4 is defined as the negative movement.

Next, description is given of a test operation executed on the flexural capacity of the column 2 with respect to the shearing force using the test apparatus 14.

Firstly, the column 2 is fixed onto the first and second load apply portions 43A and 43B, while the beam 3 is held by the hold portions 145A, 145B and is fixed along the vertical direction.

An upward load is applied to one end (in FIG. 4, the right end) of the column 2 from the first load apply portion 143A and, using the first measuring portion 144A, the amount of the upward movement of the first load apply portion 143A, that is, the upward deformation amount $\delta 1$ of one end side of the column 2 is measured. Also, substantially simultaneously with this, the same load as the load applied from the first load apply portion 143A is applied downwardly to the other end (in FIG. 4, the left end) of the column 2 from the second load apply portion 143B and, using the second measuring portion 144B, the amount of the downward movement of the second load apply portion 143B, that is, the downward deformation amount $\delta 2$ of the other end side of the column 2 is measured.

Here, the upward load applied from the first load apply portion 143A and the downward load applied from the second load apply portion 143B are respectively the shearing force that is applied to the column 2, and the mean of the deformation amounts $\delta 1$ and $\delta 2$ is expressed as the deformation amount $\delta$ of the column 2 ($\delta=(\delta 1+\delta 2)/2$).

Based on the test conducted using the test apparatus 14, the longitudinal bar 21 and normal reinforcing bar for the column 2 of this embodiment are compared in the flexural capacity with respect to the shearing force. An inter-story deflection angle X (%) is used as an index expressing the flexural capacity. The inter-story deflection angle X is the ratio of the column 2 deformation amount $\delta$ to a length L/2 which is half of the length L of the column 2 ($X=\delta\times 200/L$ (%)).

Figure 5:
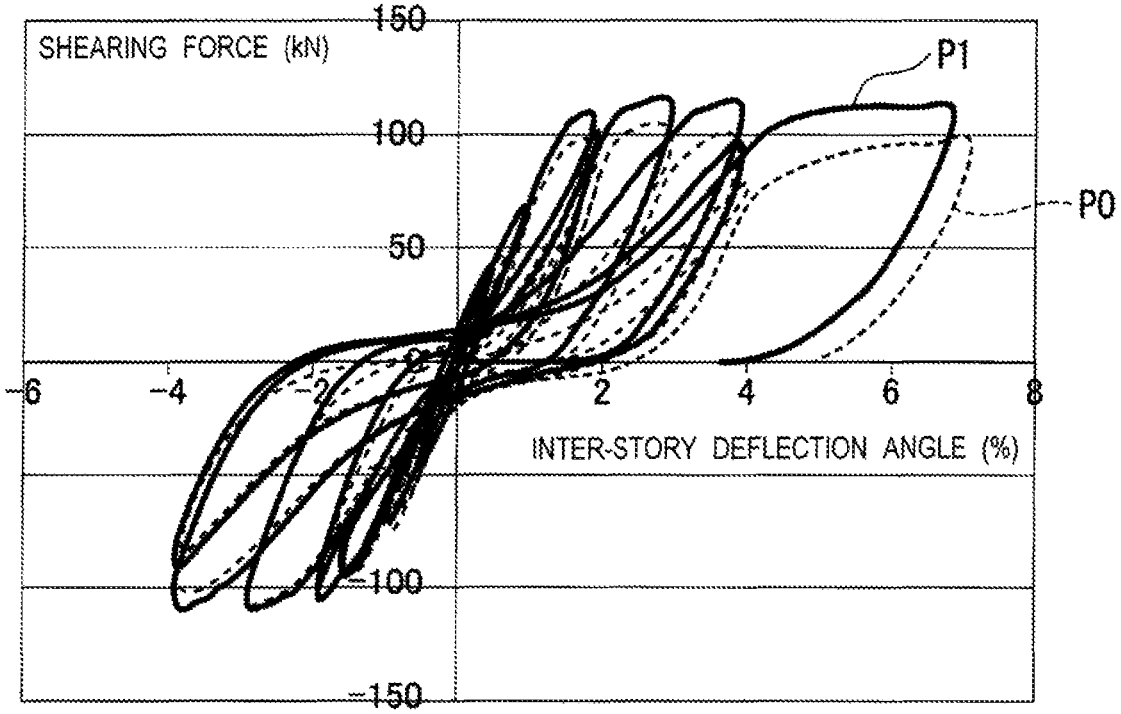
FIG. 5 is a graph showing changes in the inter-story deflection angle with respect to shearing force.

FIG. 5 is a graph having the vertical axis representing the shearing force (kN: kilonewton) and the horizontal axis representing the inter-story deflection angle X (%) is expressed on.

As shown in FIG. 5, for example, for the shearing force of 100 kN, the inter-story deflection angle X1 of the longitudinal bar 21 shown by a solid line P1 is smaller than the inter-story deflection angle X0 of the normal reinforcing bar shown by a broken line P0 (X1<X0). This holds in the whole range of the shearing force in the test, that is, X1<X0. With respect to the shearing force, the longitudinal bar 21 is harder to deform than the normal reinforcing bar and thus has higher strength.

Therefore, this embodiment can provide the following effects.

(1) In the rebar structure 1 of this embodiment, since the yield point or the 0.2% proof stress of at least a portion of the column longitudinal bars 21 is larger than the yield point or the 0.2% proof stress of the normal reinforcing bar, the at least the portion of the column longitudinal bars 21 has high strength. Therefore, each of the column longitudinal bars 21 can be thinned, whereby the spacing between the adjacent longitudinal bars 21 can be reduced. This can reduce the section area of the column 2.

(2) Also, since the yield point or the 0.2% proof stress of the column shear reinforcing bars 22 is larger than the yield point or the 0.2% proof stress of the normal reinforcing bar, the shearing force bearable by the shear reinforcing bar 22 can be increased, whereby the part borne by the concrete section of the column 2 can be reduced accordingly. This can further reduce the section area of the column 2.

(3) The high-strength reinforcing bar portion 211 includes the beam-column connecting portion 200. Stress applied to the column 2 concentrates in the beam-column connecting portion 200. Since at least the beam-column connecting portion 200 of the column longitudinal bars 21 has high strength, the proof stress of the column 2 in the beam-column connecting portion 200 can be enhanced.

(4) Since the plurality of column longitudinal bars 21 include the high-strength reinforcing bar portion 211 and the normal reinforcing bar portion 212, when compared with a structure where the entire portion of the longitudinal bars 21 has high strength, the cost of this embodiment can be reduced.

(5) An end portion of each of the column longitudinal bars 21 can overlap an end portion of another longitudinal bar 21 for the column 2. This can facilitate the connection when connecting to other longitudinal bars for the column 2.

(6) Since the column longitudinal bars 21 are formed by quenching the normal reinforcing bars, its strength can be made reliably higher than the normal reinforcing bar used as the base material.

The invention is not limited to the above embodiment.

For example, in the above embodiment, a portion of the column longitudinal bars 21 is larger in the yield point or the 0.2% proof stress than the normal reinforcing bar. However, the entire portion of the column longitudinal bars 21 may be larger in the yield point or the 0.2% proof stress than the normal reinforcing bar. In other words, at least a portion of the column longitudinal bars 21 is larger in the yield point or the 0.2% proof stress than the normal reinforcing bar.

Also, in the above embodiment, the high-strength reinforcing bar portion 211 ranges from the upper area 201 existing upwardly of the beam-column connecting portion 200 to the lower area 202 existing downwardly of the beam-column connecting portion 200, including the beam-column connecting portion 200. However, the high-strength reinforcing bar portion 211 may be arranged at least in the beam-column connecting portion 200 but may not extend over the upper area 201 or lower area 202.

In the above embodiment, the longitudinal bar 21 includes the high-strength reinforcing bar portion 211 and normal reinforcing bar portion 212. However, the longitudinal bar 21 may also include only the high-strength reinforcing bar portion 211. That is, the whole of the longitudinal bar 21 may be quenched to thereby produce a high-strength reinforcing bar having higher strength than a normal reinforcing bar.

In the above embodiment, the upper and lower end portions of the longitudinal bars 21 overlap the end portions of the other longitudinal bars 21 in a direction intersecting the axial direction of the longitudinal bar 21 (in the horizontal direction in FIG. 2). However, not limited to this, the end portions of the series-connected longitudinal bars 21 may be connected together by a coupler such as a high nut.

Next, a second embodiment of the invention will be described.

Here, parts having the same structure are given the same reference signs and the repetitive descriptions thereof will be omitted or simplified.

FIGS. 6 to 9 illustrate a rebar structure 1A according to the second embodiment of the invention.

Like the first embodiment, the rebar structure 1A is also applicable to connections S1 to S4 of a building shown in FIG. 1. In the following, the cross connection S1 will be described as an example.

Figure 6:
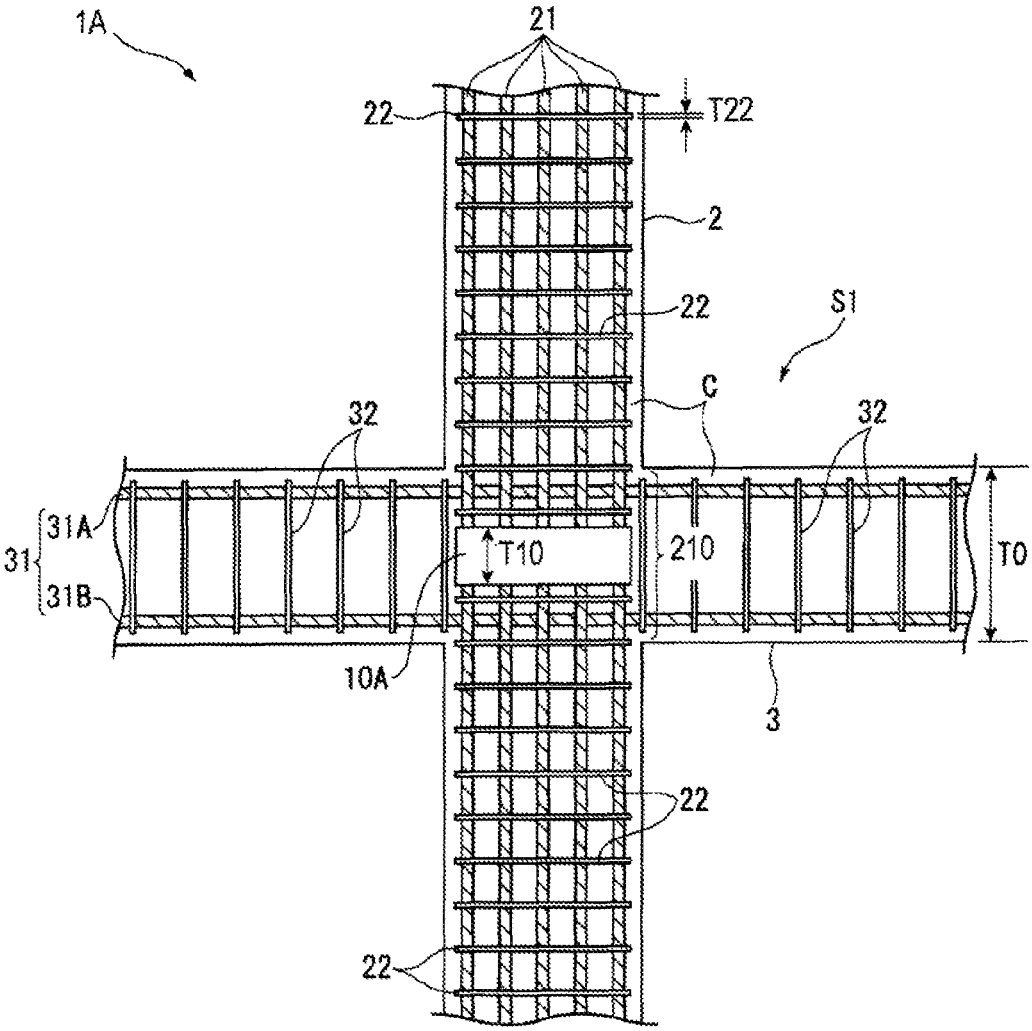
FIG. 6 is a section view of a portion of a rebar structure according to a second embodiment of the invention.
Figure 7:
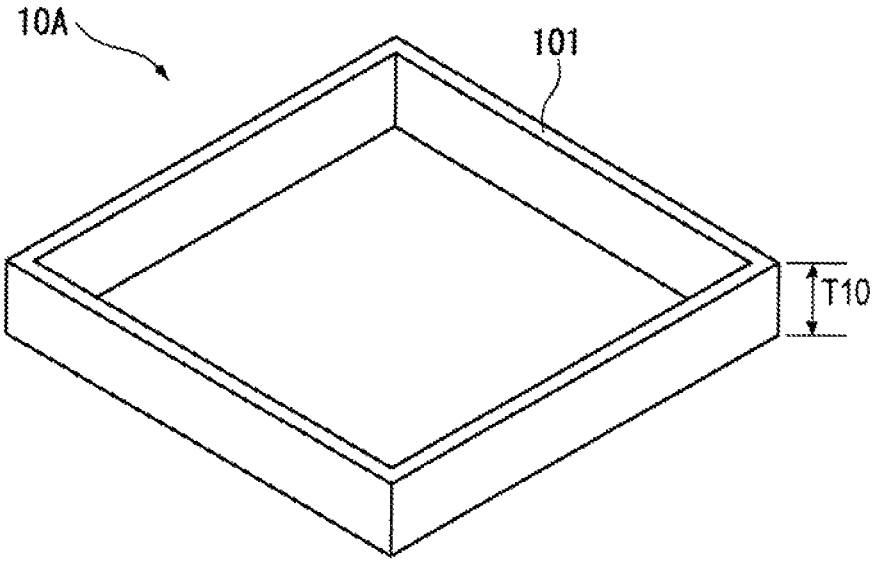
FIG. 7 is a perspective view of a reinforcing member according to the second embodiment of the invention.

As shown in FIG. 6, a rebar structure forming the column 2 includes a plurality of column longitudinal bars 21 arranged at regular intervals and extending in a vertical direction and a plurality of column shear reinforcing bars 22 arranged at regular intervals and surrounding the column longitudinal bars 21 in a plane intersecting the axial direction of the column longitudinal bars 21 (a plane perpendicular to the surface of the sheet of FIG. 6) for reinforcing the shear strength of the column 2.

The column shear reinforcing bar 22 has a given width T22 in the axial direction of the column longitudinal bar 21. The width T22 is approximately 1/70 of a beam depth T0 (T22≈T0/70). However, the column shear reinforcing bar 22 is not provided in the center of a beam-column connecting portion 210 (which is discussed later), that is, at a position where a reinforcing member 10A (which is discussed later) is provided.

A rebar structure forming the beam 3 includes a plurality of beam longitudinal bars 31 arranged at regular intervals and extending in a horizontal direction and a plurality of beam shear reinforcing bars 32 arranged at regular intervals and surrounding the beam longitudinal bars 31 in a plane intersecting the axial direction of the beam longitudinal bars 31 (a plane perpendicular to the surface of the sheet of FIG. 6) for reinforcing the shear strength of the beam 3. However, the beam shear reinforcing bars 32 are not provided in the center of a later-described beam-column connecting portion 210, that is, at a position where a later-described reinforcing member 10A is provided.

The beam longitudinal bar 31 includes an upper longitudinal bar 31A to be arranged on the upper end side of the beam 3 and a lower longitudinal bar 31B to be arranged on the lower end side of the beam 3.

The column 2 and the beam 3 are connected together in the beam-column connecting portion 210. The beam-column connecting portion 210 is an area which is surrounded by the same length as the column depth, the same length as the beam depth T0 and the same length of the width of the column 2 and beam 3 (the length of the column and beam in a direction perpendicular to the surface of the sheet of FIG. 6).

A reinforcing member 10A having a closed form is provided to surround and to restrain the plurality of column longitudinal bars 21, such that it is spaced from the upper end and the lower end of the beam-column connecting portion 210 respectively in the axial direction of the column longitudinal bars 21.

The reinforcing member 10A is formed of a general structural rolled steel member, a plate member made of metal such as iron, or a plate member made of fiber reinforced synthetic resin, and is formed as a frame-shaped outer frame 101.

The outer frame 101 is a frame the section of which has a square shape, while its width T10 in the axial direction of the column longitudinal bar 21 is approx. ¼ to ½ of the beam depth T0 (T0/4≤T10≤T0/2) and is larger than the width T22 of the column shear reinforcing bar 22 (T10>T22). The outer frame 101 is connected by welding at least in one of the four corners thereof, and provides a closed frame. To form the outer frame 101, for example, a band-shaped member such as a band-shaped steel plate may be bent into a square shape, and the start and terminal ends thereof may be butted against each other and be connected together by welding, or four rectangular steel plates serving as band-shaped members may be assembled into a square shape, and their respective ends may be butted against each other and be connected together by welding. The strength of the thus connected portion is equal to or higher than the strength of the plate member forming the reinforcing member 10A (the base member strength).

The reinforcing member 10A is arranged in the axial-direction center of the column longitudinal bars 21 while it is spaced from the upper longitudinal bar 31A and lower longitudinal bar 31B, and the inner surface of the reinforcing member 10A is contacted with the column longitudinal bars 21. Thus, the reinforcing member 10A surrounds the column longitudinal bars 21 to prevent them from being deformed due to the shearing stress that is applied to the column 2.

Therefore, this embodiment can provide the following effects.

(1) In the rebar structure 1A of this embodiment, since the reinforcing member 10A is spaced from the upper and lower ends of the beam-column connecting portion 210 in the axial direction of the column longitudinal bars 21, the reinforcing member 10A is spaced from the upper longitudinal bar 31A and lower longitudinal bar 31B, which can provide good operation efficiency when arranging the reinforcing member 10A. Also, the shearing stress applied to the column 2 acts most greatly on the center of the beam-column connecting portion 210. The portion on which the shearing stress acts most greatly can be reinforced by the reinforcing member 10A, whereby the column 2 can be reinforced sufficiently with respect to the shearing stress.

(2) The reinforcing member 10A has a closed frame shape obtained by butting the ends of the band-shaped member against each other and connecting them together by welding. Therefore, the reinforcing member 10A is strong as a whole, thereby being able to further enhance the reinforcement of the column 2 with respect to the shearing stress. Also, since the whole of the reinforcing member 10A can be made greatly strong by welding, the strength thereof can be enhanced easily.

Next, a first modified example of the second embodiment will be described with reference to FIG. 8.

Figure 8:
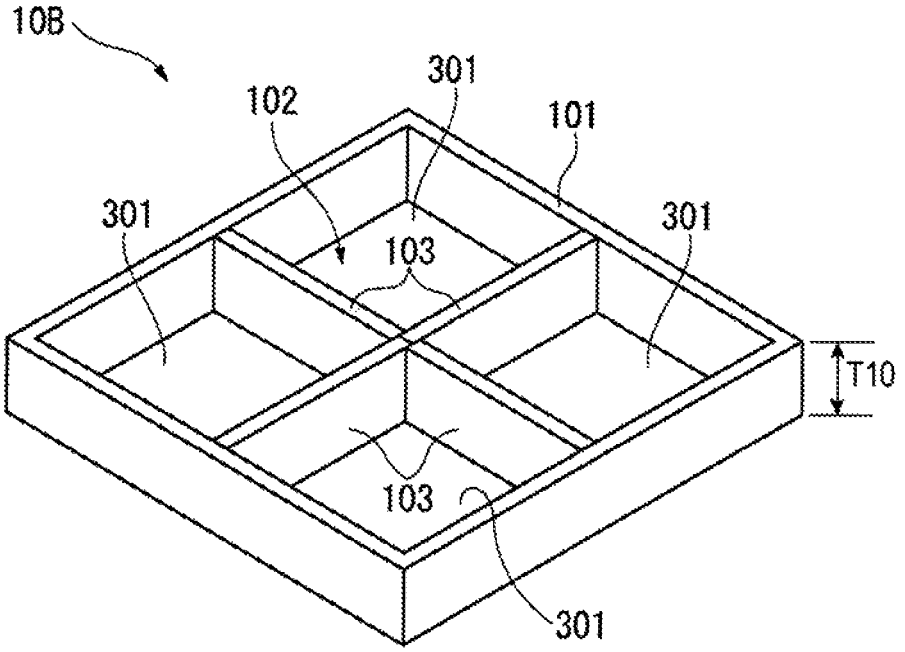
FIG. 8 is a perspective view of a reinforcing member according to a first modified example of the second embodiment.

As shown in FIG. 8, a reinforcing member 10B of this example includes an outer frame 101 and a partition portion 102 which connects together the inner surfaces of the outer frame 101 to partition off the inside of the outer frame 101.

To form the partition portion 102, for example, partition plates 103 respectively formed of a metal-made plate member may be connected together into a cross shape. The inside of the outer frame 101 is partitioned by four partition plates 103 into four reinforcing spaces 301.

The column longitudinal bars 21 are stored into the respective reinforcing spaces 301 by the reinforcing member 10B including the parathion portion 102, and the reinforcing member 10B surrounds the column longitudinal bars 21.

The rebar structure 1A of this example can provide the above-described effects (1) and (2). Further, since the reinforcing member 10B includes the outer frame 101 and partition portion 102, the outer frame 101 is reinforced by the partition portion 102. Therefore, since the outer frame 101 reinforced by the partition portion 102 cooperates with the partition portion 102 in surrounding the column longitudinal bars, the reinforcement of the column 2 can be enhanced further with respect to the shearing stress.

Next, a second modified example of the second embodiment will be described with reference to FIG. 9.

Figure 9:
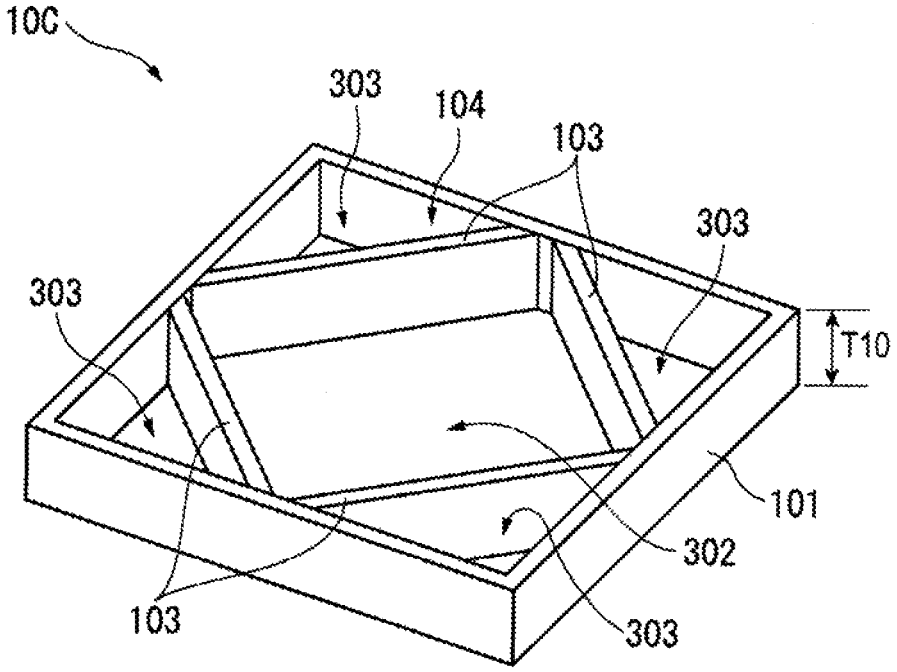
FIG. 9 is a perspective view of a reinforcing member according to a second modified example of the second embodiment.

As shown in FIG. 9, a reinforcing member 10C of this example includes an outer frame 101 and a partition portion 104 which connects together the inner surfaces of the outer frame 101 to partition off the inside of the outer frame 101.

The partition portion 104 can be formed by connecting partition plates 103 into a frame-like shape. The inside of the outer frame 101 is partitioned by four partition plates 103 into a reinforcing space 302 formed in the center of the outer frame 101 and four reinforcing spaces 303 respectively formed in the four corners.

The column longitudinal bars 21 are stored into the respective reinforcing spaces 302, 303 by the reinforcing member 10C including the partition portion 104, and the reinforcing member 10C surrounds the column longitudinal bars 21.

The rebar structure 1A of this example can provide the above-described effects (1) and (2), and further can provide the effects similar to the first modified example.

The invention is not limited to the above embodiments.

For example, in the first modified example, the partition portion 102 has a cross shape and, in the third embodiment, the partition portion 104 has a frame shape. However, not limited to this, other shapes can be employed in so far as they can connect together the inner surfaces of the outer frame 101 to partition the inside of the outer frame 101.

Also, in the second embodiment, the reinforcing member 10A surrounds the column longitudinal bars 21, the inner surface of the reinforcing member 10A is contacted with the column longitudinal bars 21, and the reinforcing member 10A is provided in the inside of the concrete C. However, not limited to this, the reinforcing member 10A may be provided on the outer surface of the concrete C and may be configured to surround and to restrain the concrete C.

Also, in the second embodiment, the outer frame 101 is a closed frame formed by butting the ends of the band-shaped member against each other and connecting them together by welding. However, they may be connected together by connecting method other than welding. Alternatively, the outer frame 101 may be integrally molded by casting or by forging.

Next, a third embodiment of the invention will be described.

Here, parts having the same structure are given the same reference signs and the repetitive descriptions thereof will be omitted or simplified.

FIGS. 10 to 15 illustrate a rebar structure 1B, 1C according to the third embodiment of the invention.

Figure 10:
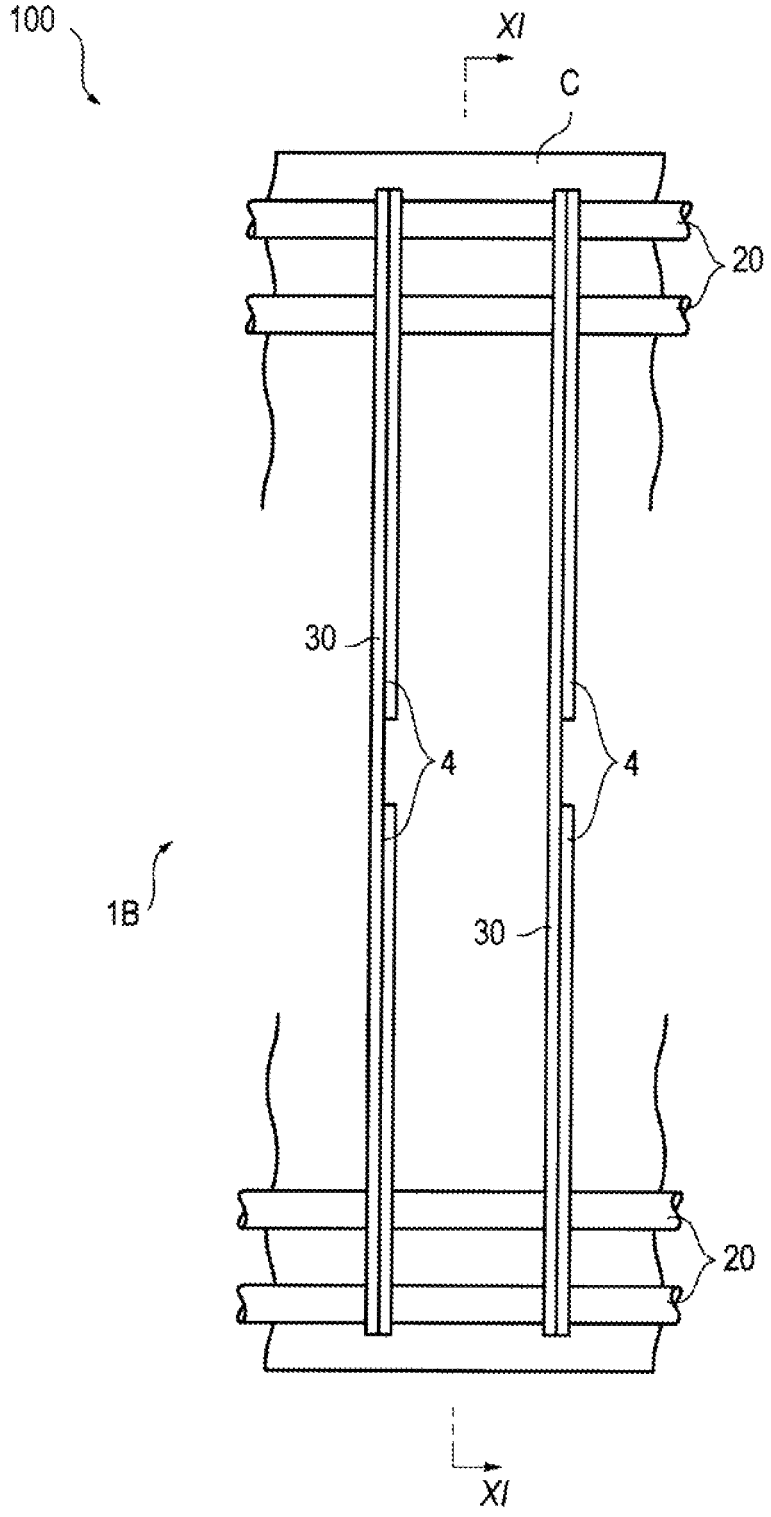
FIG. 10 is a side view of a reinforced concrete member according to a third embodiment of the invention.

As shown in FIG. 10, a reinforced concrete member 100 includes a rebar structure 1B and concrete C in which the rebar structure 1B is embedded.

The rebar structure 1B includes a plurality of longitudinal bars 20 extending in an axial direction (lateral direction in FIG. 10), a plurality of shear reinforcing bars 30 arranged to surround the longitudinal bars 20 in a rectangular form in a plane intersecting the axial direction of the longitudinal bars 20 (a plane parallel to the surface of the sheet of FIG. 11) for reinforcing the shear strength of the rebar structure 1B, and bond reinforcing bars 4 put on the shear reinforcing bars 30 in the axial direction of the longitudinal bars 20.

The longitudinal bars 20 include a first longitudinal bar 21A to a twelfth longitudinal bar 21L arranged on the outer peripheral sides (on the upper end side and lower end side in FIG. 11) of the structure. In this embodiment, the longitudinal bars 20 are arranged six pieces each on the upper end side and lower end side in FIG. 11.

The first longitudinal bar 21A to the fourth longitudinal bar 21D are arranged clockwise in the four corners of the shear reinforcing bar 30.

The fifth longitudinal bar 21E is provided between the first longitudinal bar 21A and the second longitudinal bar 21B and adjacent to the first longitudinal bar 21A, and the sixth longitudinal bar 21F is provided between the first longitudinal bar 21A and the second longitudinal bar 21B and adjacent to the second longitudinal bar 21B.

The seven longitudinal bar 21G is provided between the third longitudinal bar 21C and the fourth longitudinal bar 21D and adjacent to the third longitudinal bar 21C, and the eighth longitudinal bar 21H is provided between the third longitudinal bar 21C and the fourth longitudinal bar 21D and adjacent to the fourth longitudinal bar 21D.

The ninth longitudinal bar 21I is provided between the first longitudinal bar 21A and the fourth longitudinal bar 21D, and the tenth longitudinal bar 21J is provided between the fifth longitudinal bar 21E and the eighth longitudinal bar 21H. The eleventh longitudinal bar 21K is provided between the sixth longitudinal bar 21F and the seventh longitudinal bar 21Q and the twelfth longitudinal bar 21L is provided between the second longitudinal bar 21B and the third longitudinal bar 21C.

As shown in FIG. 10, the shear reinforcing bars 30 are arranged side by side substantially at regular intervals in the axial direction of the longitudinal bars 20. Each of the shear reinforcing bars 30 is made of a high-strength steel bar or the like and has a hoop shape.

Figure 11:
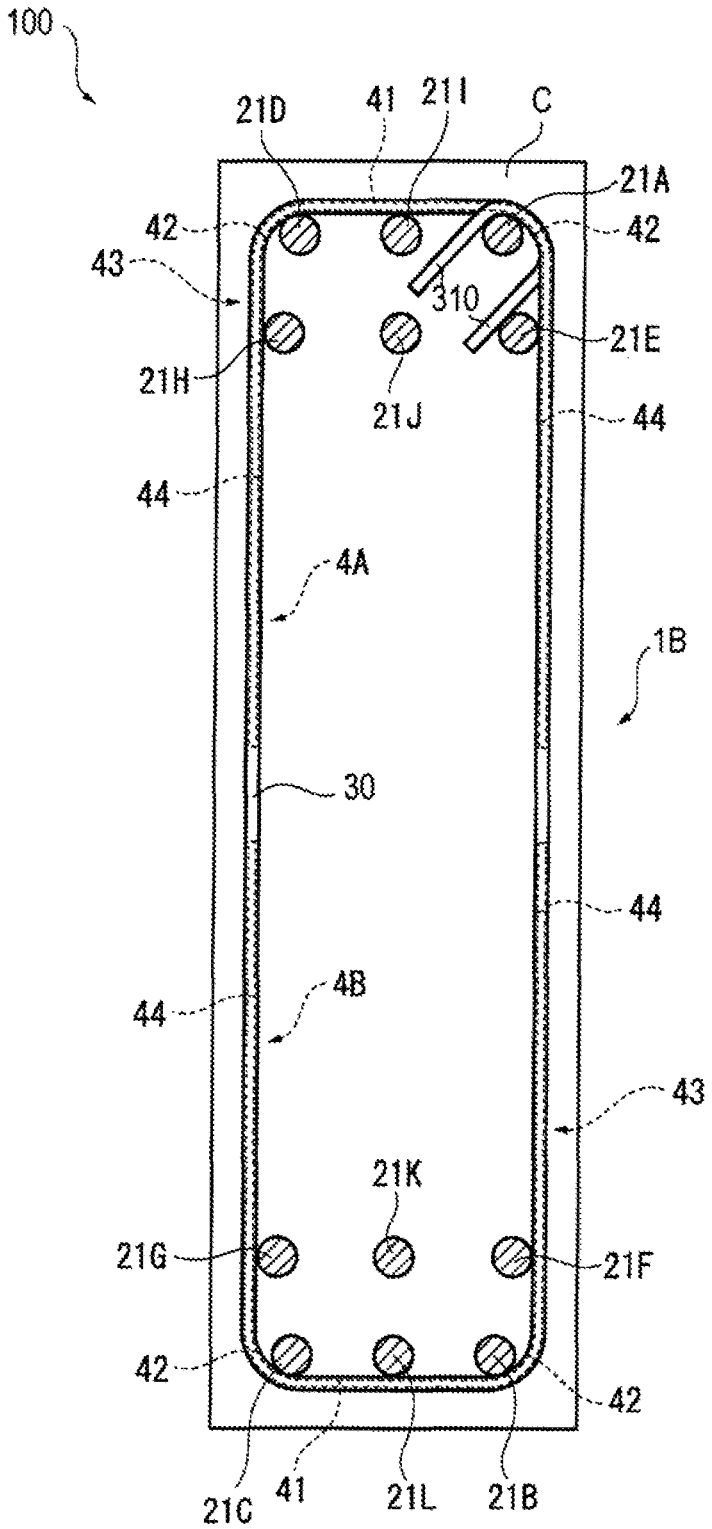
FIG. 11 is a section view taken along the line XI-XI shown in FIG. 10.
Figure 12:
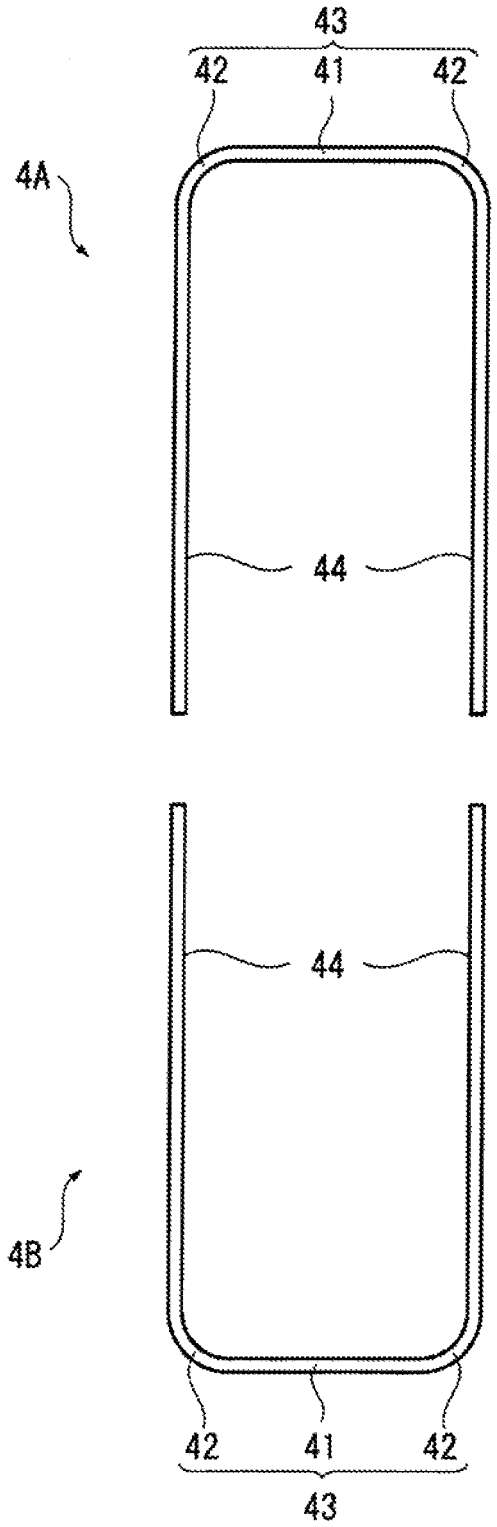
FIG. 12 is a plan view of bond reinforcing bars according to the third embodiment of the invention.

As shown in FIG. 11, the shear reinforcing bars 30 are in contact with the first longitudinal bar 21A to the ninth longitudinal bar 21I and the twelfth longitudinal bar 21L. Thus, the shear reinforcing bars 30 surround all of the longitudinal bars 21A to 21L. Here, in this embodiment, each of the shear reinforcing bars 30 includes a pair of arm portions 310 formed in its upper right corner portion in FIG. 11 and extending inwardly, while the curved section of the upper right corner portion of the shear reinforcing bar 30 and the pair of arm portions 310 cooperate to surround the first longitudinal bar 21A.

The bond reinforcing bar 4 is made of a low-strength steel member, while a pair of bond reinforcing bars 4 is provided for one shear reinforcing bar 30. The bond reinforcing bar 4 includes a first bond reinforcing bar 4A provided on the upper side in FIG. 11 and a second bond reinforcing bar 4B provided on the lower side in FIG. 11. The one-end sides of the first bond reinforcing bar 4A and second bond reinforcing bar 4B respectively have an opened U-like shape, while these opened portions are disposed opposed to each other.

The first bond reinforcing bar 4A includes a U-shaped portion 43 having a back section 41 extending in a direction (in the horizontal direction in FIG. 11) perpendicular to the axial direction of the longitudinal bar 20 and a pair of bent sections 42 bent from the two ends of the back section 41, and a pair of leg portions 44 extending from the leading end of the bent section 42 in the axial direction (in the axial direction in FIG. 11) of the bent section 42.

The back section 41 is in contact with the first longitudinal bar 21A, the fourth longitudinal bar 21D and the ninth longitudinal bar 21I, while the bent sections 42 are in contact with the first longitudinal bar 21A and the fifth longitudinal bar 21E and also with the fourth longitudinal bar 21D and the eighth longitudinal bar 21H. Accordingly, the U-shaped portion 43 is in contact with the first longitudinal bar 21A and the fourth longitudinal bar 21D.

The leg portions 44 are in contact with the fifth longitudinal bar 21E and the eighth longitudinal bar 21H and extend in the axial direction of the bent section 42 beyond the fifth longitudinal bar 21E and the eighth longitudinal bar 21H contacting therewith. The paired leg portions 44 are parallel to each other. However, the leading ends of the leg portions 44 do not reach the middle position between the first longitudinal bar 21A and the second longitudinal bar 21B and the middle position between the third longitudinal bar 21C and the fourth longitudinal bar 21D.

This first bond reinforcing bar 4A is provided around the first longitudinal bar 21A and the fourth longitudinal bar 21D, with the inner periphery of the first bond reinforcing bar 4A contacting the fifth longitudinal bar 21E and the eighth longitudinal bar 21H.

The second bond reinforcing bar 4B is similar in structure to the first bond reinforcing bar 4A, with its back section 41 contacting the second longitudinal bar 21B, the third longitudinal bar 21C and the twelfth longitudinal bar 21L, and its bent portions 42 contacting the second longitudinal bar 21B and the sixth longitudinal bar 21F, and also the third longitudinal bar 21C and the seventh longitudinal bar 21G. Accordingly, the U-shaped portion 43 is in contact with the second longitudinal bar 21B and the third longitudinal bar 21C.

The leg portions 44 are in contact with the sixth longitudinal bar 21F and the seventh longitudinal bar 21G and extend in the axial direction of the bent sections 42 beyond the sixth longitudinal bar 21F and the seventh longitudinal bar 21G contacting therewith. The leading ends of the leg portions 44 do not reach the middle position between the first longitudinal bar 21A and the second longitudinal bar 21B and the middle position between the third longitudinal bar 21C and the fourth longitudinal bar 21D.

This second bond reinforcing bar 4B is provided around the second longitudinal bar 21B and the third longitudinal bar 21C, with the inner periphery of the second bond reinforcing bar 4B contacting the sixth longitudinal bar 21F and the seventh longitudinal bar 21G.

Therefore, this embodiment can provide the following effects.

(1) In the rebar structure 1B of this embodiment, the bond reinforcing bars 4 include the first bond reinforcing bar 4A provided around the first longitudinal bar 21A and the fourth longitudinal bar 21D and having the inner periphery contacting the fifth longitudinal bar 21E and the eighth longitudinal bar 21H. Therefore, the outer peripheral end side of the rebar structure 1B that receives the shearing force the most can be reinforced in a localized manner.

(2) The bond reinforcing bar 4 includes the pair of leg portions 44 extending from the leading ends of the bent sections 42 in the axial direction of the bent sections, while the leading ends of the leg portions 44 do not reach the middle position between the first longitudinal bar 21A and second longitudinal bar 21B and the middle position between the third longitudinal bar 21C and fourth longitudinal bar 21D. This can facilitate the arrangement of the bond reinforcing bar 4 when building the rebar structure 1B.

(3) The bond reinforcing bars 4 further include the second bond reinforcing bar 4B provided around the second longitudinal bar 21B and the third longitudinal bar 21C and having the inner periphery contacting the sixth longitudinal bar 21F and the seventh longitudinal bar 21G. Therefore, the outer peripheral end side of the rebar structure 1B that receives the shearing force the most can be further reinforced in a localized manner.

(4) In the reinforced concrete member 100 of this embodiment, since the rebar structure 1B is embedded therein, the outer peripheral end side of the reinforced concrete member 100 that receives the shearing force the most can be reinforced in a localized manner.

Next, a modified example of the third embodiment according to the invention will be described.

Figure 13:
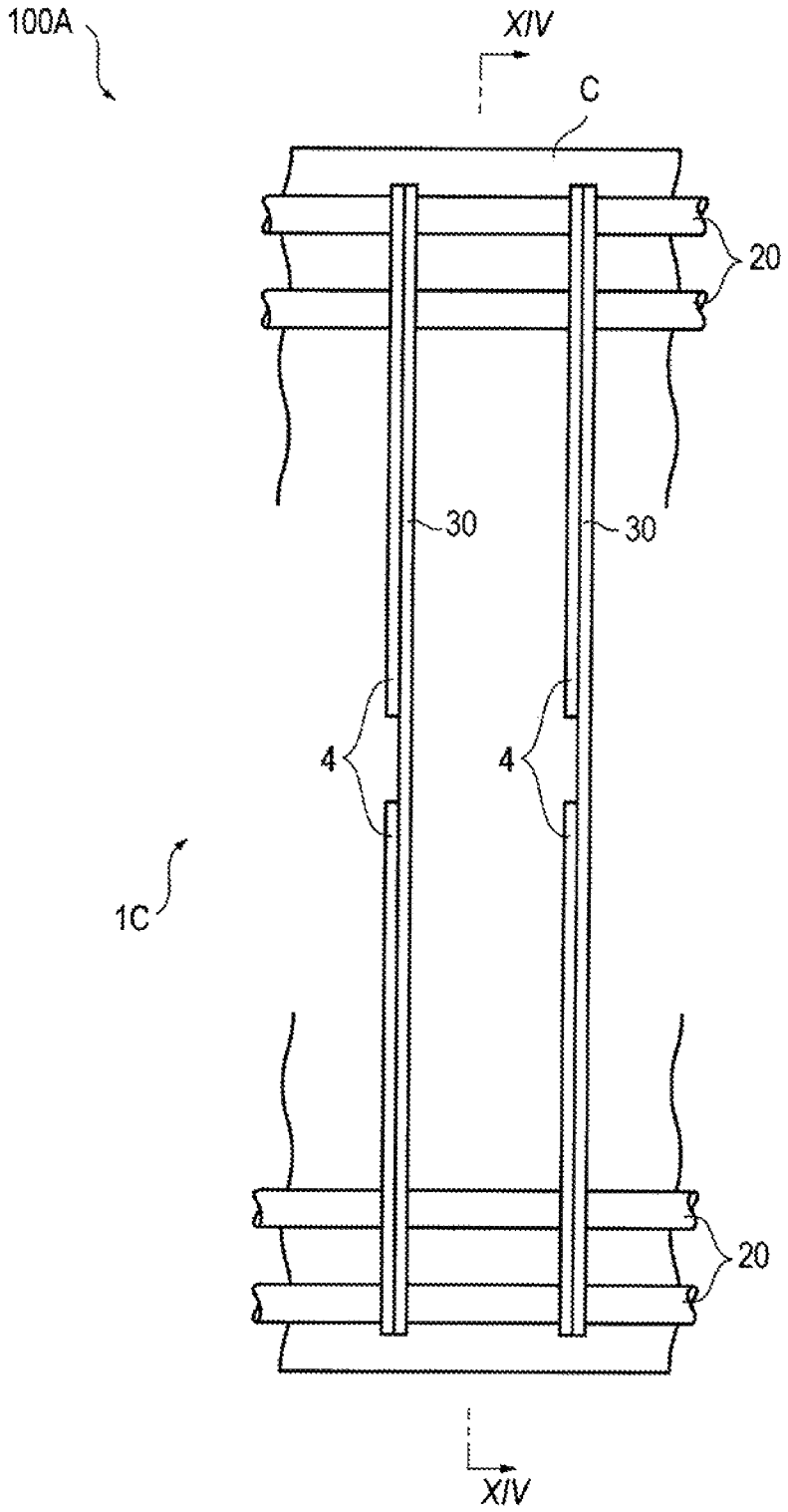
FIG. 13 is a side view of a reinforced concrete member according to a modified example of the third embodiment.
Figure 14:
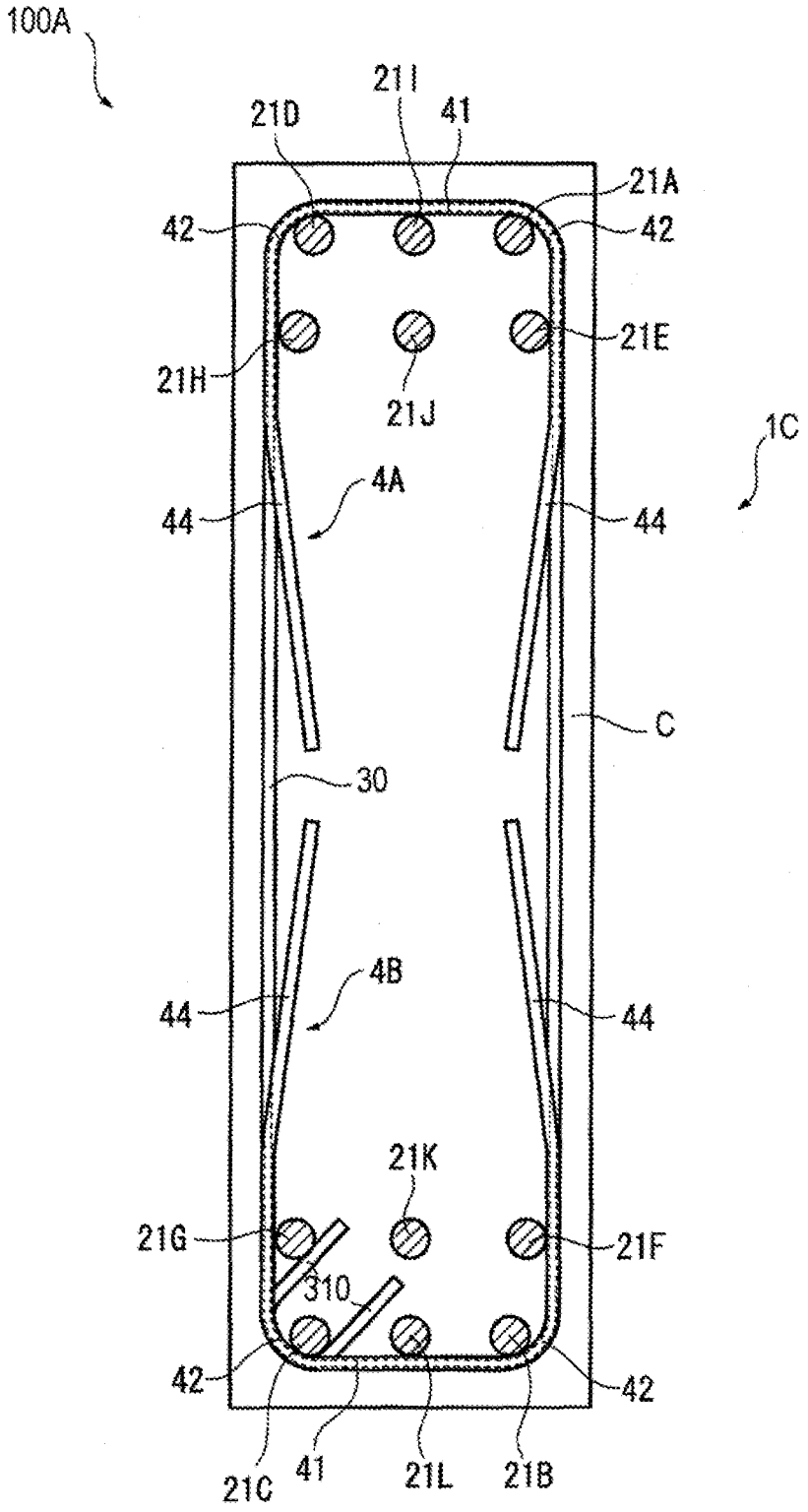
FIG. 14 is a section view taken along the line XIV-XIV shown in FIG. 13.
Figure 15:
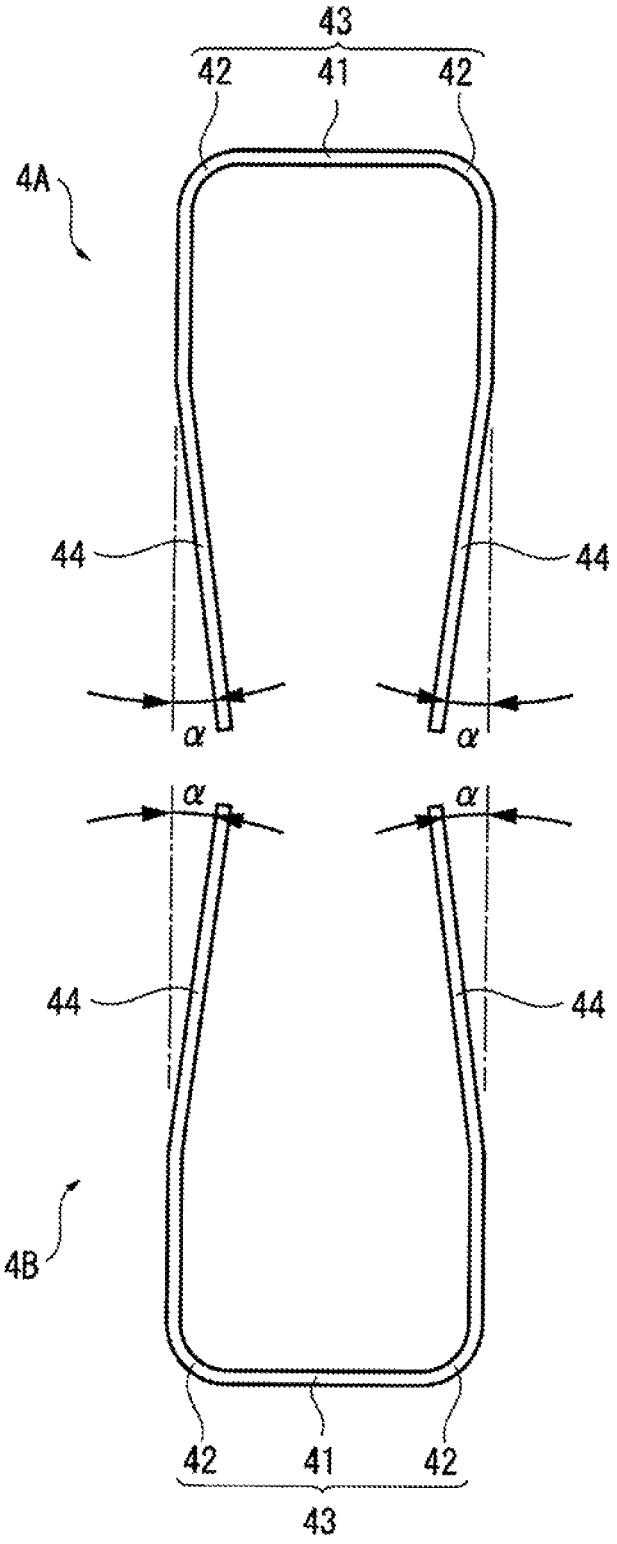
FIG. 15 is a plan view of bond reinforcing bars according to the modified example of the third embodiment.

As shown in FIGS. 13 to 15, according to a rebar structure 1C of this example, the base ends of the leg portions 44 are connected to the bent sections 42 and the leading ends thereof are oriented at a given angle $\alpha$ in mutually approaching directions. Here, in this example, the paired arm portions 310 are formed in the lower left corner portion of FIG. 14.

The rebar structure 1C and the reinforced concrete member 100A having the rebar structure 1C can provide the same effects as the effects (1) to (4) described above. In addition, the bond reinforcing bar 4 includes a pair of leg portions 44 having base ends connected to the bent sections 42 and leading ends oriented in the mutually approaching direction, and the leading ends of the leg portions 44 do not reach the middle position between the first longitudinal bar 21A and the second longitudinal bar 21B and the middle position between the third longitudinal bar 21C and the fourth longitudinal bar 21D. This makes it hard for the bond reinforcing bar 4 to be removed from inside the rebar structure 1C. Also, when building the rebar structure 1C, the installation of the bond reinforcing bar 4 can be facilitated.

Here, the invention is not limited to the above embodiments.

For example, in the above embodiments, the first longitudinal bar 21A to the fourth longitudinal bar 21D, the ninth longitudinal bar 21I and the twelfth longitudinal bar 21L are arranged along the inner periphery of the shear reinforcing bar 30. However, the longitudinal bars 20 may only be arranged at least in the four corners of the shear reinforcing bar 30.

In the above embodiments, the bond reinforcing bars 4 are arranged on the upper and lower end sides of the rebar structure 1B, 1A in an opposing manner, and the pair of bond reinforcing bars 4 is provided for one shear reinforcing bar 30. However, not limited to this, only the first bond reinforcing bar 4A on the upper end side may be provided.

In the above embodiments, the shear reinforcing bar 30 has the paired arm portions 310. However, the shear reinforcing bar 30 may not have the arm portions 310.

In the above embodiments, the inner periphery of the first bond reinforcing bar 4A is in contact with the fifth longitudinal bar 21E and the eighth longitudinal bar 21H. However, not limited to this, the inner periphery of the first bond reinforcing bar 4A may be spaced with a given distance from the fifth longitudinal bar 21E and the eighth longitudinal bar 21H, in so far as it faces the fifth longitudinal bar 21E and the eighth longitudinal bar 21H.

In the above embodiments, the leading ends of the leg portions 44 of the first bond reinforcing bar 4A do not reach the middle position between the first longitudinal bar 21A and the second longitudinal bar 21B or the middle position between the third longitudinal bar 21C and the fourth longitudinal bar 21D. However, not limited to this, they may reach the middle position between the first longitudinal bar 21A and the second longitudinal bar 21B, and the middle position between the third longitudinal bar 21C and the fourth longitudinal bar 21D.

Also, in the above embodiments, the leading ends of the leg portions 44 of the first bond reinforcing bar 4B do not reach the middle position between the first longitudinal bar 21A and the second longitudinal bar 21B or the middle position between the third longitudinal bar 21C and the fourth longitudinal bar 21D. However, not limited to this, they may reach the middle position between the first longitudinal bar 21A and the second longitudinal bar 21B, and the middle position between the third longitudinal bar 21C and the fourth longitudinal bar 21D.

The leading ends of the leg portions 44 of the first bond reinforcing bar 4A and the leading ends of the leg portions 44 of the first bond reinforcing bar 4B may overlap each other.

In the above embodiments, the U-shaped portion 43 of the first bond reinforcing bar 4A is in contact with the first longitudinal bar 21A, the fourth longitudinal bar 21D and the ninth longitudinal bar 21I. However, not limited to this, the U-shaped portion 43 may be spaced with a given distance from the first longitudinal bar 21A, the fourth longitudinal bar 21D and the ninth longitudinal bar 21I, in so far as it faces the first longitudinal bar 21A, the fourth longitudinal bar 21D and the ninth longitudinal bar 21I.

In the above embodiments, the inner periphery of the second bond reinforcing bar 4B is in contact with the sixth longitudinal bar 21F and the seventh longitudinal bar 21G. However, not limited to this, the inner periphery of the second bond reinforcing bar 4B may be spaced with a given distance from the sixth longitudinal bar 21F and the seventh longitudinal bar 21G in so far as it faces the sixth longitudinal bar 21F and the seventh longitudinal bar 21G.

The U-shaped portions 43 of the second bond reinforcing bar 4B are in contact with the second longitudinal bar 21B, the third longitudinal bar 21C and the twelfth longitudinal bar 21L. However, not limited to this, the U-shaped portions 43 may be spaced with a given distance from the second longitudinal bar 21B, the third longitudinal bar 21C and the twelfth longitudinal bar 21L, in so far as it faces the second longitudinal bar 21B, the third longitudinal bar 21C and the twelfth longitudinal bar 21L.

The invention claimed is:

1. A rebar structure comprising a column and a beam that are connected together, the column comprising a plurality of column longitudinal bars arranged to extend in a vertical direction and a plurality of column shear reinforcing bars arranged to surround the column longitudinal bars in a plane intersecting an axial direction of the column longitudinal bars, and the beam comprising a plurality of beam longitudinal bars arranged to extend in a horizontal direction, wherein, in a beam-column connecting portion where the column and the beam are connected together, a reinforcing member having a closed form is provided to surround and to restrain the column longitudinal bars, and a width of the reinforcing member in the axial direction of the column longitudinal bars is larger than a width of the column shear reinforcing bars in the axial direction of the column longitudinal bars, and the reinforcing member is spaced in the vertical direction away from an upper end of the beam-column connecting portion and spaced in the vertical direction away from a lower end of the beam-column connecting portion, and wherein the plurality of column shear reinforcing bars includes a first column shear reinforcing bar and a second column shear reinforcing bar, the first column shear reinforcing bar being provided between the upper end of the beam-column connecting portion and the reinforcing member, and spaced in the vertical direction away from the upper end of the beam-column connecting portion and spaced in the vertical direction away from the reinforcing member, and the second column shear reinforcing bar being provided between the lower end of the beam-column connecting portion and the reinforcing member, and spaced in the vertical direction away from the lower end of the beam-column connecting portion and spaced in the vertical direction away from the reinforcing member.

2. The rebar structure according to claim 1, wherein the reinforcing member comprises an outer frame and a partition portion connecting inner surfaces of the outer frame to partition an inside of the outer frame.

3. The rebar structure according to claim 1, wherein the reinforcing member has a closed frame shape in which ends of a band-shaped member are butted against each other and are connected together by welding.

4. The rebar structure according to claim 1, wherein the width of the reinforcing member in the axial direction is ¼ to ½ of a beam depth of the beam.

* * * * *